US005939365A

United States Patent [19]

Redpath et al.

[11] Patent Number: 5,939,365

[45] Date of Patent: Aug. 17, 1999

[54] LUBRICANT WITH A HIGHER MOLECULAR WEIGHT COPOLYMER LUBE OIL FLOW IMPROVER

[75] Inventors: John V. Redpath, North Brunswick; Arunas T. Lapinas, Pittstown; David J. Martella, Princeton; Albert Rossi, Warren; William M. Davis, Westfield, all of N.J.

[73] Assignee: Exxon Chemical Patents Inc., Linden, N.J.

[21] Appl. No.: 08/771,791

[22] Filed: Dec. 20, 1996

[51] Int. Cl.[6] ..... C10M 157/10

[52] U.S. Cl. ..... 508/467; 508/468; 508/472; 508/473; 508/591

[58] Field of Search ..... 508/467, 468, 508/472, 473, 591

[56] References Cited

U.S. PATENT DOCUMENTS

| | | | |
|---|---|---|---|
| 2,570,788 | 10/1951 | Giammaria | 260/485 |
| 2,628,220 | 2/1953 | Arundale et al. | 260/78.5 |
| 2,666,746 | 1/1954 | Munday et al. | 252/56 |
| 2,825,717 | 3/1958 | Cashman et al. | 260/78.5 |
| 3,413,103 | 11/1968 | Young et al. | 44/62 |
| 3,814,690 | 6/1974 | Song | 508/467 |
| 4,210,424 | 7/1980 | Feldman et al. | 44/62 |
| 4,211,534 | 7/1980 | Feldman | 44/62 |
| 4,230,811 | 10/1980 | Inyckyj | 526/227 |
| 4,261,703 | 4/1981 | Tack et al. | 44/62 |
| 4,564,460 | 1/1986 | Dorer, Jr. et al. | 252/73 |
| 4,661,121 | 4/1987 | Lewtas | 44/70 |
| 4,713,088 | 12/1987 | Tack et al. | 44/62 |
| 4,772,674 | 9/1988 | Shih et al. | 508/467 |
| 4,839,074 | 6/1989 | Rossi et al. | 252/56 D |
| 4,891,145 | 1/1990 | Brod et al. | 252/52 A |
| 4,963,279 | 10/1990 | Rosental et al. | 252/56 R |
| 5,011,505 | 4/1991 | Lewtas et al. | 44/393 |
| 5,112,510 | 5/1992 | Rossi | 252/56 R |
| 5,217,636 | 6/1993 | Paboucek | 252/56 R |
| 5,641,736 | 6/1997 | Forbus | 508/469 |

FOREIGN PATENT DOCUMENTS

| | | | |
|---|---|---|---|
| 0 272 133 A2 | 6/1988 | European Pat. Off. | C08F 218/08 |
| 0 291 006 A2 | 11/1988 | European Pat. Off. | C10M 169/04 |
| 0 385 728 A2 | 9/1990 | European Pat. Off. | C10M 157/00 |
| 2284667 | 9/1975 | France | C10M 1/28 |
| 891281 | 3/1962 | United Kingdom . | |
| 1469016 | 3/1977 | United Kingdom . | |
| 1525402 | 9/1978 | United Kingdom | C10M 1/32 |
| 1542294 | 3/1979 | United Kingdom . | |
| WO89/01507 | 2/1989 | WIPO | C10M 105/18 |

*Primary Examiner*—Jerry D. Johnson

[57] ABSTRACT

A lubricant which comprises: a mineral oil basestock which has been dewaxed via catalytic cracking and/or catalytic isomerization; an alkylene-alkylene copolymer; and a lubricating oil flow improver formed from the reaction product of: (a) an unsaturated carboxy ester formed via the esterification of an unsaturated carboxylic acid or its corresponding anhydride with a monohydric aliphatic alcohol having an average carbon number of between about 10 to 18, the unsaturated carboxy ester having the formula:

wherein R' is selected from the group consisting of hydrogen and COOR and wherein R is a $C_6$ to $C_{22}$ alkyl group; and (b) a monomer selected from the group consisting of (i) a vinyl ester having the formula:

wherein $R_1$ comprises an alkyl group containing from 1 to 18 carbon atoms;

(ii) an olefin having the formula wherein $R_1$ and $R_2$ can independently be hydrogen, an alkyl having from 1 to 28 carbon atoms, or a substituted aryl group, provided both $R_1$ and $R_2$ are not hydrogen, the reaction product having a specific viscosity in the range between about 0.3 to 1.5, or a weight average molecular weight of between about 50,000 to 350,000 Daltons.

20 Claims, 2 Drawing Sheets

LUBRICANT WITH A HIGHER MOLECULAR WEIGHT COPOLYMER LUBE OIL FLOW IMPROVER

The present invention is generally directed to a novel higher molecular weight dialkyl fumarate-vinyl acetate copolymer (FVA polymer) that is particularly useful as a lube oil flow improver (LOFI) or pour point depressant in lubricating oils. The resulting blend of the higher molecular weight FVA copolymer and lubricating oils demonstrates superior low temperature performance properties versus conventional FVA polymers.

BACKGROUND OF THE INVENTION

A wide variety of compounds for use as lubricating oil or fuel oil additives are known in this art. These include compounds typically referred to as pour point depressants, viscosity index improving compositions, wax crystal modifiers, lube oil flow improvers, and the like. In particular, US-A-2825717 (Cashman et al.) discloses the preparation of certain lubricating oil additives by the copolymerization of polycarboxylic acid esters with other polymerizable monomeric materials, including vinyl compounds such as vinyl acetate. The preferred unsaturated polycarboxylic acid esters therein are fumaric acid esters produced from $C_1$ through $C_{18}$ aliphatic alcohols.

US-A-2618602 (Bartlett) discloses pour point depressing and/or viscosity index improving materials obtained by polymerizing certain specified alkyl fumarate esters. In particular, Bartlett discloses the use of polymerized fumarate esters of $C_{12}$ to $C_{14}$ alcohols for such purposes. Moreover, Bartlett specifically discloses that the $C_{12}$ alcohol was more effective than the $C_{14}$ alcohol, although both polymerized esters exhibited pour point depressing properties.

US-A-4088589 (Rossi et al.) discloses the use of specified mixtures of lubricating oil pour point depressants which include polyesters consisting of a polymeric ester of acrylic acid or methacrylic acid and a monohydric alcohol containing from 10 to 18 carbon atoms, and/or interpolymers of a vinyl alcohol ester of a $C_2$ to $C_{18}$ alkanoic acid (e.g., vinyl acetate) and a di($C_6$–$C_{18}$ alkyl) fumarate as one of the components thereof for improving the viscosity index of high wax content lubricating oils which also include viscosity index improving ethylene copolymers. Also, US-A-3250715 (Wyman) discloses terpolymers of dialkyl fumarates, vinyl esters, and alkyl vinyl ethers for improving the pour point of lubricating oils, and most particularly in which the dialkyl fumarates are prepared for various $C_{10}$ through $C_{18}$ alcohols including tetradecyl alcohol alone as well as alcohol mixtures averaging from 12 to 14 carbon atoms.

There has also been disclosed in US-A-4713088 (Tack) the use in various middle distillate fuel compositions for lowering the pour point and controlling the size of wax crystals. These compositions specifically include polymers and copolymers of specific dialkyl fumarate-vinyl acetate copolymers. Most specifically, it discloses the use of such additives in which the average number of carbon atoms in the alkyl groups in the polymer or copolymer must be from 12 to 14. In addition these additives are also disclosed as being useful in combination with the polyoxyalkylene esters, ethers, ester/ethers and mixtures thereof, as well as with various other additives. Furthermore, GB-A-2023645 discloses, for use in treating distillate fuel oils, various three-component systems which include as a first component flow improvers having an ethylene backbone, such as various ethylene polymers including ethylene polymerized with various mono- or di-esters (e.g., vinyl acetate; and $C_{13}$ fumarates), as a second component a lube oil pour depressant such as various oil soluble esters and/or higher olefin polymers (e.g., dialkyl fumarate-vinyl acetate copolymers), and as a third component various polar oil-soluble compounds (e.g., phenates, sulfonates, phosphates and carboxylates).

It is also disclosed in US-A-4661121 (Lewtas) and US-A-4661122 (Lewtas) that the size of wax crystals forming in fuels boiling in the range of 120° C. to 500° C. can be controlled by an additive which includes the polymers and copolymers of mono- and di-n-alkyl esters of monoethylenically unsaturated $C_4$ to $C_8$ mono- or di-carboxylic acids, in which the average number of carbon atoms in the n-alkyl groups is from 14 to 18. These patents show a preference for copolymers of di-n-alkyl fumarates and vinyl acetate, and specifically state that the fumarates can be made from single alcohols or mixtures of alcohols, and when mixtures are used they are mixed prior to esterification. Furthermore, these patents disclose the use of various ethylene unsaturated ester copolymer flow improvers as co-additives therewith, but do not specify that these additives are produced from alcohol mixtures.

Still others have disclosed as a dewaxing aid a copolymer of dialkyl fumarate-vinyl acetate in which a large proportion of the alkyl groups are $C_{20}$ to $C_{24}$ alkyl groups.

The aforementioned lower molecular weight FVA copolymers are typically formed from a higher temperature exothermic process in combination with the other key operating variables. The conventional process manufactures a FVA copolymer with a weight average molecular weight as measured by a GPC column with a polystyrene standard typically between 20,000 and 50,000 Daltons which can also be correlated to the measurement of specific viscosity which has been measured between 0.2 and 0.3. The conventional preferred way to make this product commercially is to charge the reactor with vinyl acetate and dialkyfulmarate (DAF) in a molar ratio between 0.8 and 0.85. The process is run either in the presence of a solvent such as cyclohexane or run in the absence of solvent. The solvated process maintains the polymerization reaction at about 109° C. The unsolvated process starts at about 94° C., but is allowed to exotherm in excess of 121° C. It is then temperature controlled around a set point of 116° C. The initiator, TBPO can either be added in continuously in the solvated process or added in several discrete additions in the unsolvated process. This is done to moderate the exotherms generated in the absence of solvent. The initiator concentration in the reactor is about 0.15 weight percent of the total.

However, the present inventors have discovered that higher molecular weight (i.e., 50,000 to 350,000 Daltons) FVA copolymers can be made by changes in conventional process conditions, i.e., reaction temperatures, residence time, free radical initiator concentration, number of initiator additions during reaction and the molar ratio of vinyl acetate to dialkyl fumarate (VA:DAF). These higher molecular weight FVA copolymers of the present invention have been demonstrated to significantly improve low temperature properties of formulated oils comprising an alkylene/alkylene viscosity index copolymer.

These higher molecular weight FVA copolymers of the present invention perform particularly well in catalytic and isodewaxed basestocks at competitive treat rates. The performance data presented hereafter demonstrates that higher molecular weight FVA copolymer active ingredient treats in finished crankcase oil can be accomplished if used in an amount of approximately 0.11%, based on the total amount of finished crankcase oil. By comparison, conventional lower molecular weight FVA copolymers require approximately 0.4% active ingredient in the finished oil to pass the stringent low temperature tests. While this benefit is evident in crankcase oils, the present inventors believe that this improvement will allow pour point depressants to be more effective in power transmission fluids, gear oils, tractor hydraulic fluids (THF) and all other industrial lubricants that require low temperature flow and pour point performance. In addition, the higher molecular weight FVA copolymers of the present invention provide a more potent additive for use in fuel treatment, wax and flow improvement applications.

SUMMARY OF THE INVENTION

This invention relates to a lubricant which comprises a mineral oil basestock which has been dewaxed via catalytic cracking and/or catalytic isomerization; an alkylene-alkylene copolymer; and a lubricating oil flow improver formed from the reaction product of:

(a) an unsaturated carboxy ester formed via the esterification of an unsaturated carboxylic acid or its corresponding anhydride with a monohydric aliphatic alcohol having an average carbon number of between about 10 to 18, said unsaturated carboxy ester having the formula:

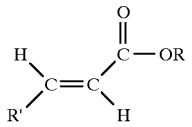

wherein R' is selected from the group consisting of hydrogen and COOR and wherein R is a $C_6$ to $C_{22}$ alkyl group; and (b) a monomer selected from the group consisting of (i) a vinyl ester having the formula:

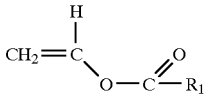

wherein $R_1$ comprises an alkyl group containing from 1 to 18 carbon atoms, and (ii) an olefin having the formula

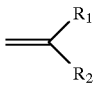

wherein $R_1$ and $R_2$ can independently be hydrogen, an alkyl having from 1 to 28 carbon atoms, or a substituted aryl group, provided both $R_1$ and $R_2$ are not hydrogen, said reaction product having a specific viscosity in the range between about 0.3 to 1.5, or a weight average molecular weight of between about 50,000 to 350,000 Daltons.

The lubricating oil flow improver is preferably added to the lubricant in an amount between about 0.005 to 10 wt. %, based upon the total lubricant, more preferably between about 0.01 to 2 wt. %, and most preferably between about 0.025 to 0.25 wt. %.

The lubricant is one selected from the group consisting of crankcase oils, power transmission fluids, gear oils, tractor hydraulic fluids, hydraulic fluids, two cycle engine oils, catapult oils, drilling fluids, turbine oils, compressor oils, greases, and functional fluids.

The lubricant exhibits the following low temperature properties: a pour point of less than about −30° C.; a MRV viscosity of less than about 60,000 cps at −30° C.; and a MRV yield stress of less than about 35.

The alkylene-alkylene copolymer is preferably an ethylene propylene copolymer. The unsaturated carboxy ester is preferably dialkyl fumarate (DAF) and the vinyl ester is preferably vinyl acetate. The average carbon number of the DAF alcohol is between about 12 to 14, more preferably between about 12.5 to 13.5.

The lubricant oil flow improver used to form the novel lubricant according to the present invention is formed from a reaction product having a specific viscosity in the range between about 0.3 to 1.0, and a weight average molecular weight of between about 50,000 to 200,000 Daltons, more preferably between about 0.45 to 0.7 and a weight average molecular weight of between about 75,000 to 120,000 Daltons.

The present invention also includes a process for formulating a lubricant which comprises the steps of: blending the following components: (a) a mineral oil basestock which has been dewaxed via catalytic cracking and/or catalytic isomerization; (b) an alkylene-alkylene copolymer; and (c) the reaction mixture of:

(i) an unsaturated carboxy ester formed via the esterification of an unsaturated carboxylic acid or its corresponding anhydride with a monohydric aliphatic alcohol having an average carbon number of between about 10 to 18, the unsaturated carboxy ester having the formula:

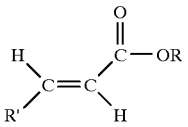

wherein R' is selected from the group consisting of hydrogen and COOR and wherein R is a $C_{10}$ to $C_{18}$ alkyl group; and (ii) a monomer selected from the group consisting of:

(1) a vinyl ester having the formula:

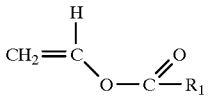

wherein $R_1$ comprises an alkyl group containing from 1 to 18 carbon atoms, and (2) an olefin having the formula

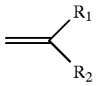

wherein $R_1$ and $R_2$ can independently be hydrogen, an alkyl having from 1 to 28 carbon atoms, or a substituted aryl group, provided both $R_1$ and $R_2$ are not hydrogen, such that the ratio of monomer (ii) to unsaturated carboxy ester (i) is between about 0.80:1 to 10:1; and (iii) an initiator in an amount between about 0.05 to 0.25 wt. %, based on the total reaction mixture; and heating the reaction mixture to a temperature in the range between about 80° C. to 130° C. for a period of between about 2.5 to 6 hours from the time after the initiator addition to the reaction mixture; whereby a lubricating oil flow improver is formed having a specific viscosity in the range between about 0.3 to 1.5, or a weight average molecular weight of between about 50,000 to 350,000 Daltons.

It is preferred that the ratio of monomer to unsaturated carboxy ester is between about 0.85:1 to 2.5:1. Moreover, the reaction mixture is typically heated to a temperature in the range between about 80° C. to 100° C.

DETAILED DESCRIPTION OF THE PREFERRED EMBODIMENT

Figure 1A:
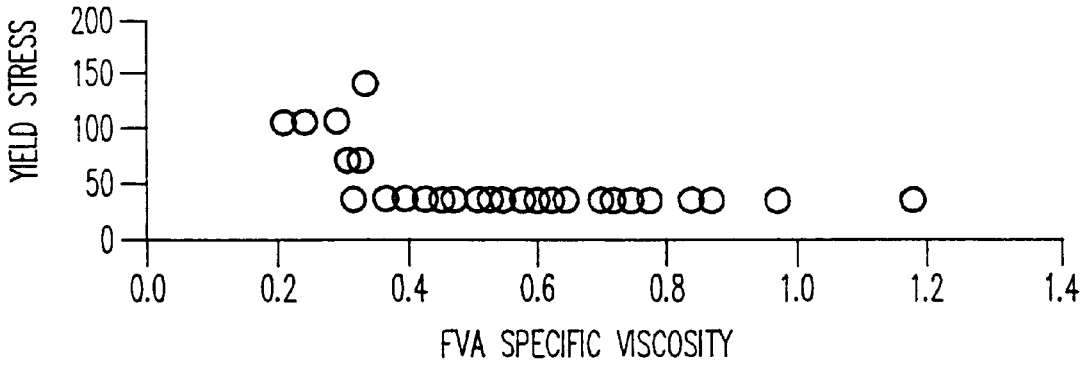
FIG. 1*a* is a plot of FVA specific viscosity versus MRV yield stress at −30° C. for an isodewaxed 10W-40 passenger car motor oil (PCMO)

The oleaginous compositions of the present invention comprise: an oleaginous material, preferably a lubricating oil, generally in a major amount; and an additive comprised of a higher molecular weight lubricating oil flow improver comprising non-ethylene containing copolymers which are soluble or dispersible in these oleaginous materials.

The general term "lubricating oil flow improver" (LOFI) covers all those additives which modify the size, number, and growth of wax crystals in lube oils in such a way as to impart improved low temperature handling, pumpability, and/or vehicle operability as measured by such tests as pour point and mini rotary viscometry (MRV). The majority of lubricating oil flow improvers are polymers or contain polymers. These polymers are generally of two types, either backbone or sidechain.

The unique higher molecular weight FVA copolymers according to the present invention are formed from dialkyl fumarate alcohols having an average carbon number of between about 10 to 18, more preferably between about 12 to 14, and most preferably between about 12.5 to 13.5. Moreover, these higher molecular weight FVA copolymers have a specific viscosity in the range between about 0.3 to 1.5, preferably between about 0.3 to 1.0, and most preferably between about 0.45 to 0.7, or a weight average molecular weight of between about 50,000 to 350,000 Daltons, preferably between about 50,000 to 200,000 Daltons, and most preferably between about 75,000 to 120,000 Daltons.

The backbone variety have various lengths of methylene segments randomly distributed in the backbone of the polymer, which associate or co-crystallize with the wax crystals inhibiting further crystal growth due to branches and non-crystallizable segments in the polymer.

The sidechain type polymers, which are the predominant variety used as LOFI's, have methylene segments as the side chains, preferably as straight side chains. These polymers work similarly to the backbone type except the side chains have been found more effective in treating isoparaffins as well as n-paraffins found in lube oils.

The lube oil flow improvers of the present invention generally comprise longchain flow improving polymers of the sidechain type, which contain pendent ester groups derived from a mixture of alcohols whereby the alcohol residue can be characterized as repeating methylene units, and which are oil soluble, or dispersible, polymeric compositions that generally have higher molecular weights determined by gel permeation chromatography, i.e., molecular weights in the range between about 50,000 to 350,000 Daltons, preferably 50,000 to 200,000 Daltons, and most preferably between about 70,000 to 120,000 Daltons.

Alternatively, such molecular weights of the LOFI of the present invention are more conveniently expressed by the specific viscosity exhibited by such polymers. Accordingly, such specific viscosities will typically be at least 0.3, more preferably between about 0.3 to 1.0, and most preferably between about 0.4 to 0.7.

Such specific viscosities are determined in accordance with the following equation:

$$\text{Specific Viscosity}=(\text{K-vis of Solution}/\text{K-vis of Solvent})-1$$

wherein "K-vis of Solution" is the kinematic viscosity at 40° C. of a 2.0 mass/volume percent solution of the polymer (a.i. basis) in toluene (solvent) available commercially, using Ubbelohde-type viscometers with a viscometer constant of about 0.004 cSt/second, and the "K-vis of Solvent" is the corresponding kinematic viscosity of the solvent alone at the same temperature. All specific viscosities reported herein are determined by the above method.

The novel lubricating oil flow improver according to the present invention is preferably formed from the reaction product of:

(a) an unsaturated carboxy ester formed via the esterification of an unsaturated carboxylic acid or its corresponding anhydride with a monohydric aliphatic alcohol having an average carbon number of between about 10 to 18, the unsaturated carboxy ester having the formula:

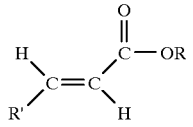

wherein R' is selected from the group consisting of hydrogen and COOR and wherein R is a $C_{10}$ to $C_{18}$ alkyl group; and (b) a monomer selected from the group consisting of (i) a vinyl ester having the formula:

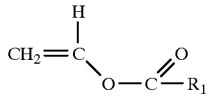

wherein $R_1$ comprises an alkyl group containing from 1 to 18 carbon atoms, and (ii) an olefin having the formula:

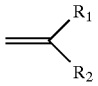

wherein $R_1$ and $R_2$ can independently be hydrogen, an alkyl group having from 1 to 28, preferably 8 to 16, carbon atoms, or a substituted aryl group. The aryl group may be substituted with a variety of substituents, including but not limited to, halogens, heteroatoms such as sulfur or nitrogen, or an alkyl group. Preferably, the aryl group will be substituted with an alkyl group having from 1 to 5 carbon atoms. Typical examples of the olefin include propylene, isobutylene, butene, pentene, hexene, decene, dodecene, tetradecene, hexadecene, octadecene, styrene, α-methylstyrene or 4-methylstyrene. The reaction product preferably has a specific viscosity in the range between about 0.3 to 1.5, or a weight average molecular weight of between about 50,000 to 350,000 Daltons.

Suitable ethylenically unsaturated carboxylic acids or their anhydrides, which are eventually esterified to form the unsaturated carboxy ester, have the carboxyl or anhydride groups located on vicinal carbons, and have 4 to 10 carbons in the unesterified monomer molecule. Suitable carboxylic acids or anhydrides include fumaric acid, maleic anhydride, mesaconic acid, citraconic acid and its anhydride, and itaconic acid and its anhydride.

The particular carboxylic acid or anhydride monomer which is preferred will depend on the identity of its comonomer. Thus, when the comonomer is a vinyl ester, the preferred carboxylic acid is fumaric acid. When the comonomer is an alpha-olefin or styrene, the preferred carboxylic monomer is maleic anhydride.

Accordingly, esterification is conducted with mixtures of alcohols, which alcohols can be slightly branched, preferably straight chain, most preferably straight chain alkyl. Thus, the alcohols used for esterification are typically selected from the $C_{10}$ to $C_{18}$ aliphatic alcohols, preferably the $C_{12}$ to $C_{16}$ aliphatic alcohols, and most preferably the $C_{12}$ to $C_{14}$ aliphatic alcohols; provided that the average carbon number of the resultant alcohol is between about 10 to 18, preferably 12 to 14, and most preferably 12.5 to 13.5. Primary alcohols are preferred over secondary and tertiary alcohols, and the alcohols are preferably saturated, although some degree of unsaturation (i.e., less than about 2 mole %) is permissible in various alcohol mixtures. Straight and lightly branched chain alcohols are preferred over highly branched alcohols.

Representative examples of suitable alcohols thus include n-octyl alcohol, capryl alcohol, n-decyl alcohol, lauryl alcohol, myristyl alcohol, cetyl alcohol, margaryl alcohol, stearyl alcohol, arachidyl alcohol, behenyl alcohol, lignoceryl alcohol, myricyl alcohol and melissyl alcohol.

The present invention also includes a process for forming a lubricating oil flow improver which comprises the steps of:

(1) charging into a reaction vessel the following reaction mixture:

(a) an unsaturated carboxy ester formed via the esterification of an unsaturated carboxylic acid or its corresponding anhydride with a monohydric aliphatic alcohol having an average carbon number of between about 10 to 18, the unsaturated carboxy ester having the formula:

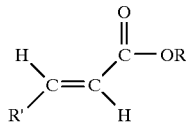

wherein R' is selected from the group consisting of hydrogen and COOR and wherein R is a $C_{10}$ to $C_8$ alkyl group;

(b) a monomer selected from the group consisting of (i) a vinyl ester having the formula:

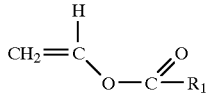

wherein $R_1$ comprises an alkyl group containing from 1 to 18 carbon atoms, (ii) an olefin having the formula

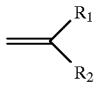

wherein $R_1$ and $R_2$ can independently be hydrogen, an alkyl having from 1 to 28 carbon atoms, or a substituted aryl group, provided both $R_1$ and $R_2$ are not hydrogen, such that the ratio of monomer (b) to unsaturated carboxy ester (a) is between about 0.80:1 to 10:1; and (c) an initiator in an amount between about 0.05 to 0.25 wt. %, based on the total reaction mixture; and (2) heating the reaction mixture to a temperature in the range between about 80° C. to 130° C., more preferably between about 80° C. to 100° C., for a period of between about 2.5 to 6 hours from the time after the initiator addition to the reaction mixture; whereby a lubricating oil flow improver is formed having a specific viscosity in the range between about 0.3 to 1.5, or a weight average molecular weight of between about 50,000 to 350,000 Daltons.

The preferred lubricating oil flow improvers are $C_{10}$ to $C_{18}$ dialkyl fumarate-vinyl acetate copolymers. The mole ratio of the vinyl ester to unsaturated carboxyl monomer in the polymerization reaction mixture can vary typically from about 0.80:1 to 10:1, preferably 0.90:1 to 1.5:1.

EXAMPLE 1

All reactions and results listed in Tables 1A and 1B below were obtained using a metal reaction vessel capable of operating at elevated pressure. The vessel was a 300 ml stainless steel batch container. Tables 1A and 1B below list various FVA copolymers which were generated with a variety of process conditions and with the performance results listed. The major variables were vinyl acetate to DAF molar ratio, the reaction starting temperature, reaction exotherm, the weight percent of the free radical initiator (e.g., t-butyl peroctoate (TBPO)), the sequence timing and proportioning of TBPO into the reaction and the residence time of the reaction. In this case, residence time is defined as the total initiator addition time (equals 2.5 hours in all runs) plus a soak period. If the residence time is equal to 2.5 hours, then there is no soak time. The performance data listed is for a SAE 10W-40 lubricating oil blended with isodewaxed basestock. All blends were treated with 0.11 percent active ingredient of FVA copolymer. The relevant low temperature tests for the crankcase lubricating oil is MRV (ASTM D3829) yield stress less than 35 MPa, MRV viscosity of less than 60,000 centipoise at −30° C.

TABLE 1A

| Run No. | % Active Ingredient | VA/DAF Mole Ratio | Reaction Temp. °C. | wt. % TBPO | Residence Time (hours) |
|---|---|---|---|---|---|
| 1 | 48.8 | 1 | 80 | 0.075 | 2.5 |
| 2 | 77.7 | 1 | 80 | 0.3 | 2.5 |
| 3 | 99.9 | 1 | 80 | 0.3 | 6.0 |
| 4 | 74.5 | 0.8 | 80 | 0.3 | 2.5 |
| 5 | 79.9 | 0.8 | 80 | 0.15 | 6.0 |
| 6 | 96.3 | 1 | 80 | 0.15 | 6.0 |
| 7 | 66.7 | 1 | 80 | 0.15 | 2.5 |
| 8 | 68.7 | 0.8 | 80 | 0.075 | 6.0 |
| 9 | 94.8 | 0.8 | 80 | 0.3 | 6.0 |
| 10 | 45.2 | 0.8 | 80 | 0.15 | 2.5 |
| 11 | 90.9 | 1 | 80 | 0.15 | 6.0 |
| 12 | 89.9 | 1 | 79 | 0.15 | 3.8 |
| 13 | 94.1 | 1 | 80 | 0.3 | 6.0 |
| 14 | 88.1 | 1 | 84 | 0.075 | 6.0 |
| 15 | 100 | 1 | 80 | 0.3 | 6.0 |
| 16 | 96.5 | 1 | 90 | 0.15 | 6.0 |
| 17 | 99.9 | 1 | 90 | 0.15 | 6.0 |
| 18* | 69.6 | 1 | 87 | 0.15 | 4.0 |
| 19 | 90.2 | 1 | 100 | 0.10 | 6.0 |
| 20 | 98.9 | 1 | 101 | 0.22 | 6.0 |
| 21 | 95.8 | 1 | 100 | 0.15 | 6.0 |
| 22 | 92.1 | 1 | 101 | 0.15 | 6.0 |
| 23* | 94.2 | 1 | 100 | 0.15 | 6.0 |
| 24* | 96.8 | 1 | 100 | 0.15 | 3.5 |
| 25 | 98.2 | 1 | 101 | 0.3 | 6.0 |
| 26 | 96.9 | 1 | 100 | 0.15 | 5.0 |
| 27 | 88.8 | 1 | 100 | 0.15 | 6.0 |
| 28 | 94.7 | 1 | 100 | 0.12 | 6.0 |
| 29 | 95.2 | 1 | 110 | 0.15 | 6.0 |
| 30 | 92.8 | 1 | 120 | 0.15 | 2.5 |
| 31 | 94.3 | 1 | 120 | 0.15 | 5.0 |
| 32 | 89.2 | 0.8 | 120 | 0.15 | 6.0 |
| 33 | 78.1 | 1 | 110 | 0.15 | 6.0 |
| 34 | 93.7 | 1 | 120 | 0.15 | 6.0 |
| 35 | 91.5 | 0.8 | 120 | 0.3 | 2.5 |
| 36 | 73.8 | 0.8 | 120 | 0.15 | 6.0 |
| 37 | 81.1 | 1 | 120 | 0.15 | 6.0 |
| 38 | 69.6 | 0.8 | 120 | 0.15 | 2.5 |

*denotes that nitrogen stripping occurred.

TABLE 1B

| Run No. | MRV Yield Stress | MRV App. Viscosity at −30° C. | Pour Point (°C.) | Specific Vis. | Low Temperature Performance (Pass/Fail) |
|---|---|---|---|---|---|
| 1 | <35 | 21,413 | −30 | 0.6175 | P |
| 2 | <35 | 21,655 | −30 | 0.6947 | P |
| 3 | <35 | 21,841 | −33 | 1.2230 | P |
| 4 | <35 | 22,033 | −33 | 0.5139 | P |
| 5 | <35 | 22,973 | −30 | 0.5211 | P |
| 6 | <35 | 23,048 | −33 | 0.8637 | P |
| 7 | <35 | 23,144 | −36 | 0.6382 | P |
| 8 | <35 | 23,243 | −36 | 0.4640 | P |
| 9 | <35 | 23,279 | −36 | 0.5955 | P |
| 10 | <35 | 23,692 | −36 | 0.5019 | P |
| 11 | <35 | 23,971 | −36 | 0.7166 | P |
| 12 | <35 | 24,123 | −36 | 0.7736 | P |
| 13 | <35 | 24,413 | −36 | 0.9668 | P |
| 14 | <35 | 37,337 | −27 | 0.7200 | P |
| 15 | <35 | 38,790 | −36 | 0.8655 | P |
| 16 | <35 | 23,300 | −36 | 0.9983 | P |
| 17 | <35 | 23,300 | −36 | 0.7493 | P |
| 18 | <35 | 35,724 | −30 | 0.5709 | P |
| 19 | <35 | 23,000 | −36 | 0.362 | P |
| 20 | <35 | 23,200 | −33 | 0.4182 | P |

TABLE 1B-continued

| Run No. | MRV Yield Stress | MRV App. Viscosity at −30° C. | Pour Point (°C.) | Specific Vis. | Low Temperature Performance (Pass/Fail) |
|---|---|---|---|---|---|
| 21 | <35 | 23,900 | −30 | 0.6078 | P |
| 22 | <35 | 25,000 | −36 | 0.4127 | P |
| 23 | <35 | 25,000 | −33 | 0.4157 | P |
| 24 | <35 | 23,500 | −30 | 0.4477 | P |
| 25 | <35 | 27,900 | −33 | 0.5217 | P |
| 26 | <35 | 28,808 | −36 | 0.5298 | P |
| 27 | <35 | 39,100 | −33 | 0.3749 | P |
| 28 | <35 | 24,000 | −36 | 0.3885 | P |
| 29 | <35 | 22,800 | −39 | 0.4241 | P |
| 30 | <70 | 83,327 | −33 | 0.3049 | F |
| 31 | <70 | 123,241 | −36 | 0.3239 | F |
| 32 | <105 | 160,033 | −33 | 0.2463 | F |
| 33 | <70 | 160,400 | −36 | 0.2438 | F |
| 34 | <105 | 167,800 | −39 | 0.2402 | F |
| 35 | <105 | 201,517 | −33 | 0.2867 | F |
| 36 | <105 | 228,747 | −36 | 0.2055 | F |
| 37 | <140 | 299,377 | −33 | 0.3314 | F |
| 38 | <105 | 300,000 | −33 | 0.2202 | F |

Table 1A lists the various factors (vinyl acetate/dialkyl fumarate molar ratio, reaction temperature, amount of catalyst and residence time) that were varied to produce copolymers of different molecular weights. Table 1B shows the low temperature performance of these polymers in an isodewaxed basestock. The results clearly show that copolymers of weight average molecular weight, as measured by specific viscosity, show excellent low temperature performance. Copolymers with specific viscosities above about 0.35 give passing low temperature performance in the MRV test. In contrast, copolymers with specific viscosities below about 0.35 give failing low temperature performance in the MRV test.

It is most surprising that a manipulation of several key variables would result in a dramatic improvement in the performance of the molecule. Previous conventional wisdom was that the performance of pour point depressants or LOFI was independent of molecular weight. If molecular weight was not important, then a process to manipulate the molecular weight of the polymer was not relevant. The present invention has sent forth above data which supports the claim of the present invention that specific viscosity and molecular weight greatly effect the low temperature performance in isomerization and/or catalytic dewaxed basestocks. The discovery by the present inventors that there is a minimum specific viscosity and molecular weight which is required for meeting a specific performance criteria is therefore a surprising result. Therefore, the present inventors have discovered that through process refinements higher molecular weight FVA copolymer lube oil flow improvers can be formulated.

EXAMPLE 2

Table 2 demonstrates the conditions under which the data set forth in Tables 3 and 4 was obtained. Tables 3 and 4 below demonstrate that a reduced treat rate of 0.055 wt. % of the LOFI of the present invention in either an isodewaxed or catalytic dewaxed basestock is still effective in meeting the critical low temperature properties discussed above; provided that the reaction product has a specific viscosity in the range between about 0.45 and 0.7 and a weight average molecular weight of between about 75,000 to 120,000 Daltons.

TABLE 2

| Run No. | % Active Ingredient | VA/DAF Mole Ratio | Reaction Temp. °C. | wt. % TBPO | Residence Time (hours) |
|---|---|---|---|---|---|
| 1 | 68.7 | 0.8 | 80 | 0.075 | 6 |
| 2 | 45.2 | 0.8 | 80 | 0.15 | 2.5 |
| 3 | 74.5 | 0.8 | 80 | 0.3 | 2.5 |
| 4 | 79.9 | 0.8 | 80 | 0.15 | 6 |
| 5 | 96.9 | 1.0 | 100 | 0.15 | 5 |
| 6 | 69.6 | 1.0 | 87 | 0.15 | 4 |
| 7 | 48.8 | 1.0 | 80 | 0.075 | 2.5 |
| 8 | 66.7 | 1.0 | 80 | 0.15 | 2.5 |
| 9 | 77.7 | 1.0 | 80 | 0.3 | 2.5 |
| 10 | 90.9 | 1.0 | 80 | 0.15 | 6 |
| 11 | 89.9 | 1.0 | 79 | 0.15 | 3.8 |
| 12 | 96.3 | 1.0 | 80 | 0.15 | 6 |
| 13 | 100 | 1.0 | 80 | 0.3 | 6 |
| 14 | 94.1 | 1.0 | 80 | 0.3 | 6 |
| 15 | 99.9 | 1.0 | 80 | 0.3 | 6 |
| 16 | 88.1 | 1.0 | 84 | 0.075 | 6 |

TABLE 3

(Isodewaxed Basestock)

| Run No. | MRV Yield Stress | MRV app. Viscosity at −30° C. | Pour Point (°C.) | Specific Vis. | Low Temperature Performance (Pass/Fail) |
|---|---|---|---|---|---|
| 1 | <70 | 76,900 | −27 | 0.4640 | F |
| 2 | <35 | 42,200 | −36 | 0.5019 | P |
| 3 | <70 | 59,400 | −27 | 0.5139 | F |
| 4 | <70 | 83,100 | −33 | 0.5211 | F |
| 5 | <245 | 723,000 | −21 | 0.5298 | F |
| 6 | <70 | 54,300 | −30 | 0.5709 | F |
| 7 | <35 | 32,500 | −27 | 0.6175 | P |
| 8 | <35 | 33,400 | −30 | 0.63382 | P |
| 9 | <35 | 46,100 | −27 | 0.6947 | P |
| 10 | <105 | 69,000 | −24 | 0.7166 | F |
| 11 | <70 | 55,800 | −30 | 0.7736 | F |
| 12 | <70 | 69,100 | −21 | 0.8637 | F |
| 13 | <140 | 153,300 | −24 | 0.8655 | F |
| 14 | <175 | 138,000 | −21 | 0.9668 | F |
| 15 | <175 | 106,400 | −21 | 1.2230 | F |
| 16 | <70 | 57,400 | −18 | 1.2764 | F |

TABLE 4

(Catalytic Dewaxed Basestock)

| Run No. | MRV Yield Stress | MRV App. Viscosity at −30° C. | Pour Point (°C.) | Specific Vis. | Low Temperature Performance (Pass/Fail) |
|---|---|---|---|---|---|
| 1 | <175 | 127,600 | −33 | 0.4640 | F |
| 2 | <35 | 41,600 | −30 | 0.5019 | P |
| 3 | <105 | 64,800 | −33 | 0.5139 | F |
| 4 | <105 | 78,600 | −36 | 0.5211 | F |
| 5 | <210 | 279,000 | −30 | 0.5298 | F |
| 6 | <70 | 53,000 | −33 | 0.5709 | F |
| 7 | <35 | 42,000 | −30 | 0.6175 | P |
| 8 | <35 | 40,300 | −33 | 0.63382 | P |
| 9 | <70 | 48,500 | −33 | 0.6947 | F |
| 10 | <105 | 53,000 | −27 | 0.7166 | F |
| 11 | <105 | 49,400 | −30 | 0.7736 | F |
| 12 | <105 | 55,200 | −30 | 0.8637 | F |
| 13 | <175 | 127,600 | −33 | 0.8655 | F |
| 14 | <140 | 126,600 | −27 | 0.9668 | F |
| 15 | <70 | 49,200 | −33 | 1.2230 | F |
| 16 | <70 | 57,400 | −18 | 1.2764 | F |

COMPARATIVE EXAMPLE 3

As shown in Table 5A, the polymers of Comparative Example 3 were generated with the same process conditions of Example 1. Comparative Example 3 demonstrates that in addition to molecular weight the average number of carbon atoms in the alkyl groups of the polymer or copolymer is preferably between 12 and 14. The average number of carbon atoms in the alkyl groups of the polymers of comparative Example 3 is 12.0. As shown in table 5B, all of the polymers of Comparative Example 3 fail the MRV low temperature performance test even though they are high molecular weight (i.e., specific viscosity of less than 0.35). In this case, residence time is defined as the total initiator addition time (equals 2.5 hours in all runs) plus a soak period. If the residence time is equal to 2.5 hours, then there is no soak time. The performance data listed is for a SAE 10W-40 lubricating oil blended with isodewaxed basestock. All blends were treated with 0.11 percent active ingredient of copolymer. The relevant low temperature tests for the crankcase lubricating oil is MRV yield stress less than 35 MPa, MRV viscosity of less than 60,000 centipoise at −30° C. and a pour point of lower than −30° C.

TABLE 5A

| Run No. | % Active Ingredient | VA/DAF Mole Ratio | Reaction Temp. °C. | wt. % TBPO | Residence Time (hours) |
|---|---|---|---|---|---|
| 1 | 94.2 | 1.0 | 110 | 0.08 | 6 |
| 2 | 97.8 | 0.9 | 100 | 0.21 | 4 |
| 3 | 76.3 | 1.0 | 110 | 0.15 | 6 |
| 4 | 95.8 | 1.0 | 100 | 0.15 | 6 |

TABLE 5B

| Run No. | MRV Yield Stress | MRV App. Viscosity −30° C. | Pour Point (°C) | Specific Viscosity | Low Temp. Performance |
|---|---|---|---|---|---|
| 1 | <70 | 655,000 | −33 | 0.47 | F |
| 2 | <70 | 544,000 | −30 | 0.57 | F |
| 3 | <70 | TVTM* | −27 | 0.35 | F |
| 4 | <70 | 1,850,000 | −33 | 0.61 | F |

*TVTM denotes too viscous to measure.

That measure of performance can be quantified by adding the low and high molecular weight FVA copolymer LOFI to the lubricating oil at the same active ingredient treat rates as measured by dialysis. The higher molecular weight FVA copolymers of the present invention with a specific viscosity between about 0.3 to 1.5 and a weight average molecular weight between about 50,000 to 350,000 can demonstrate passing performance in the low temperature viscosity tests at one third of the active ingredient of the lower molecular weight FVA copolymers having a specific viscosity between 0.2 to 0.3 or a weight average molecular weight between 20,000 to 50,000.

For example, in a crankcase lubricating oil formulated with a high ethylene viscosity modifier (i.e., from about 40 to 60% ethylene) to a SAE 10W-40 grade oil, that the lower molecular weight FVA copolymer will require an active ingredient treat of 0.3 weight percent or greater to pass all low temperature tests. The improved higher molecular weight FVA copolymer will treat the same lubricant formulation at 0.1 weight % and pass all low temperature tests.

Figure 1B:
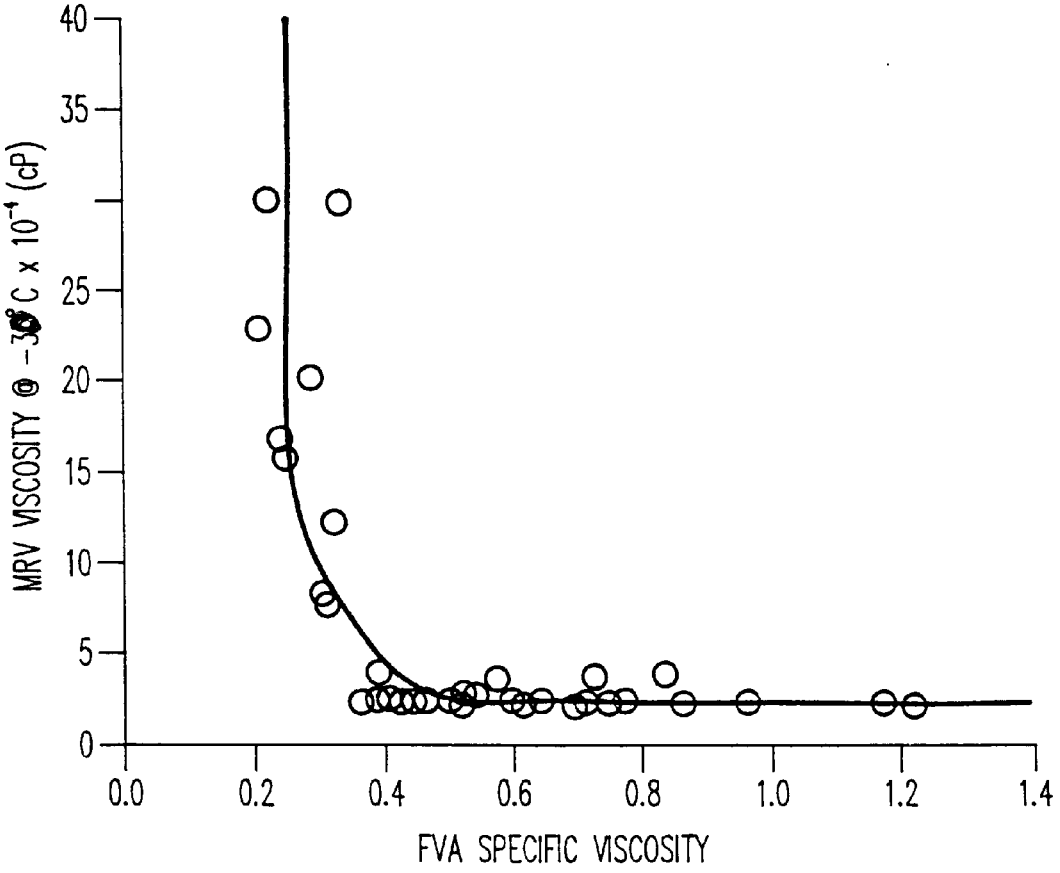
FIG. 1*b* is a plot of specific viscosity versus MRV viscosity at −30° C. for an isodewaxed 10W-40 PCMO.

FIGS. 1A and 1B show a plot of low temperature performance of fumarate-vinyl acetate copolymers of different molecular weights as measured by specific viscosity in an isodewaxed basestock. The plot demonstrates the superior performance of high molecular weight fumarate-vinyl acetate copolymers.

Figure 2A:
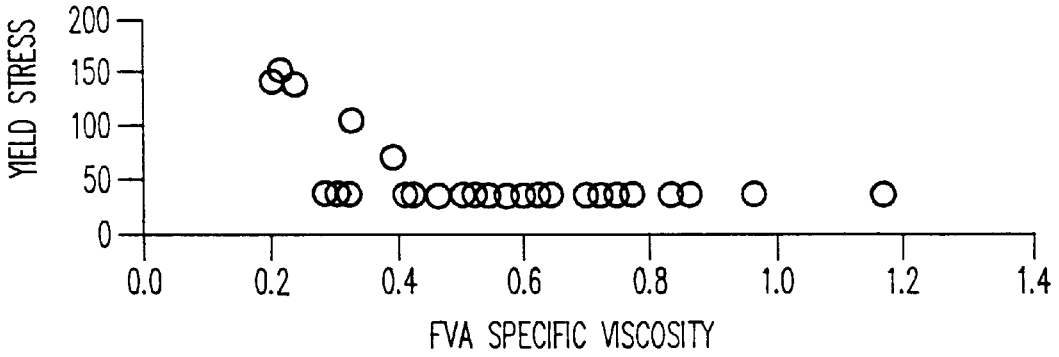
FIG. 2*a* is a plot of FVA specific viscosity versus MRV yield stress at −30° C. for a catalytic dewaxed 10W-40 PCMO.
Figure 2B:
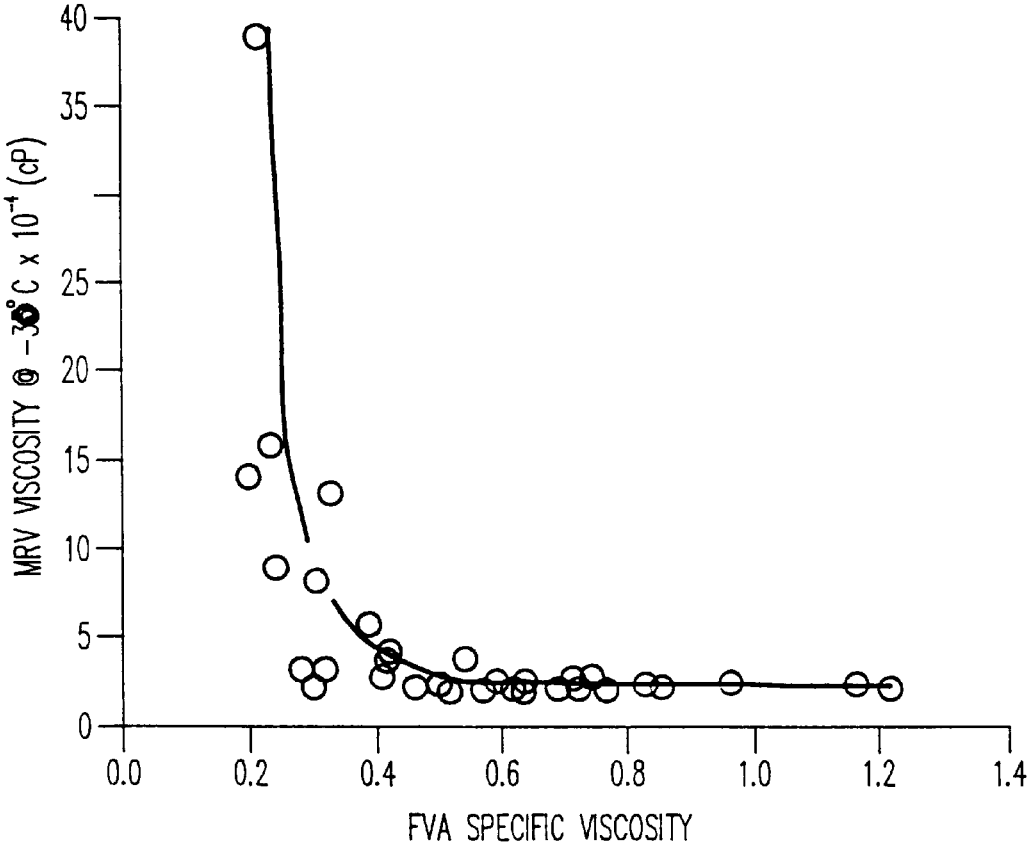
FIG. 2*b* is a plot of specific viscosity versus MRV viscosity at −30° C. for an catalytic dewaxed 10W-40 PCMO.

FIGS. 2A and 2B show a plot of low temperature performance of fumarate-vinyl acetate copolymers of different molecular weights as measured by specific viscosity in a catalytic dewaxed basestock. The plot demonstrates the superior performance of high molecular weight fumarate-vinyl acetate copolymers.

What is claimed is:

1. A lubricant which comprises:

a mineral oil basestock which has been dewaxed via catalytic cracking and/or catalytic isomerization;

an alkylene-alkylene copolymer; and a lubricating oil flow improver formed from the reaction product of:

(a) an unsaturated carboxy ester formed via the esterification of an unsaturated carboxylic acid or its corresponding anhydride with a monohydric aliphatic alcohol having an average carbon number of between about 10 to 18, said unsaturated carboxy ester having the formula:

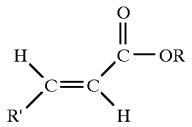

wherein R' is selected from the group consisting of hydrogen and COOR and wherein R is a $C_{10}$ to $C_{18}$ alkyl group; and (b) a monomer selected from the group consisting of (i) a vinyl ester having the formula:

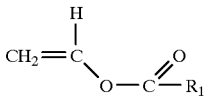

wherein $R_1$ comprises an alkyl group containing from 1 to 18 carbon atoms; and (ii) an olefin having the formula

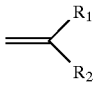

wherein $R_1$ and $R_2$ can independently be hydrogen, an alkyl having from 1 to 28 carbon atoms, or a substituted aryl group, provided both $R_1$ and $R_2$ are not hydrogen, said reaction product having a specific viscosity in the range between about 0.3 to 1.5, or a weight average molecular weight of between about 50,000 to 350,000 Daltons.

2. The lubricant according to claim 1 wherein said lubricating oil flow improver is added to said lubricant in an amount between about 0.005 to 10 wt. %, based upon the total lubricant.

3. The lubricant according to claim 2 wherein said lubricating oil flow improver is added to said lubricant in an amount between about 0.01 to 2 wt. %, based upon the total lubricant.

4. The lubricant according to claim 1 wherein said lubricant exhibits a pour point of less than about −30° C.

5. The lubricant according to claim 1 wherein said lubricant exhibits a MRV viscosity of less than about 60,000 cps at −30° C.

6. The lubricant according to claim 1 wherein said lubricant exhibits a MRV yield stress of less than about 35 MPa.

7. The lubricant according to claim 1 wherein said alkylene-alkylene copolymer is an ethylene propylene copolymer.

8. The lubricant according to claim 1 wherein said unsaturated carboxy ester comprises dialkyl fumarate.

9. The lubricant according to claim 1 wherein said vinyl ester comprises vinyl acetate.

10. The lubricant according to claim 1 wherein the olefin is selected from the group consisting of propylene, isobutylene, butene, pentene, hexene, decene, dodecene, tetradecene, hexadecene, octadecene, styrene, α-methylstyrene or 4-methylstyrene.

11. The lubricant according to claim 1 wherein said average carbon number of said alcohol is between about 12 to 14.

12. The lubricant according to claim 11 wherein said average carbon number of said alcohol is between about 12.5 to 13.5.

13. The lubricant according to claim 1 wherein said reaction product has a specific viscosity in the range between about 0.3 to 1.0, and a weight average molecular weight of between about 50,000 to 200,000 Daltons.

14. A process for formulating a lubricant comprising the steps of:

blending the following components:

(a) a mineral oil basestock which has been dewaxed via catalytic cracking and/or catalytic isomerization;

(b) an alkylene-alkylene copolymer; and (c) the reaction mixture of:

(i) an unsaturated carboxy ester formed via the esterification of an unsaturated carboxylic acid or its corresponding anhydride with a monohydric aliphatic alcohol having an average carbon number of between about 10 to 18, said unsaturated carboxy ester having the formula:

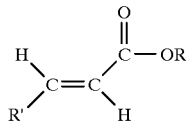

wherein R' is selected from the group consisting of hydrogen and COOR and wherein R is a $C_{10}$ to $C_{18}$ alkyl group;

(ii) a monomer selected from the group consisting of (1) a vinyl ester having the formula:

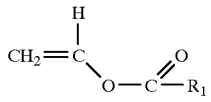

wherein $R_1$ comprises an alkyl group containing from 1 to 18 carbon atoms, and (2) an olefin having the formula

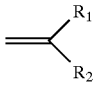

wherein $R_1$ and $R_2$ can independently be hydrogen, an alkyl having from 1 to 28 carbon atoms, or a substituted aryl group, provided both $R_1$ and $R_2$ are not hydrogen, such that the ratio of monomer to unsaturated carboxy ester is between about 0.80:1 to 10:1; and (iii) an initiator in an amount between about 0.05 to 0.25 wt. %, based on the total reaction mixture; and heating said reaction mixture to a temperature in the range between about 80° C. to 130° C. for a period of between about 2.5 to 6 hours from the time after said initiator addition to said reaction mixture; whereby a lubricating oil flow improver is formed having a specific viscosity in the range between about 0.3 to 1.5, or a weight average molecular weight of between about 50,000 to 350,000 Daltons.

15. The process according to claim 14 wherein said ratio of monomer to unsaturated carboxy ester is between about 0.85:1 to 2.5:1.

16. The process according to claim 14 wherein said reaction mixture is heated to a temperature in the range between about 80° C. to 100° C.

17. The process according to claim 14 wherein said average carbon number of said alcohol is between about 12 to 14.

18. The process according to claim 17 wherein said average carbon number of said alcohol is between about 12.5 to 13.5.

19. The process according to claim 14 wherein said reaction product has a specific viscosity in the range between about 0.45 to 0.7 and a weight average molecular weight of between about 75,000 to 120,000 Daltons.

20. The process according to claim 14 wherein said unsaturated carboxy ester comprises dialkyl fumarate.

* * * * *

UNITED STATES PATENT AND TRADEMARK OFFICE

CERTIFICATE OF CORRECTION

PATENT NO. : 5,939,365

DATED : August 17, 1999

INVENTOR(S) : John V. Redpath, et al.

It is certified that error appears in the above-identified patent and that said Letters Patent is hereby corrected as shown below:

In column 8, line 9, change "$C_8$" to --$C_{18}$--.

Signed and Sealed this

Eighth Day of August, 2000

*Attest:*

Q. TODD DICKINSON

*Attesting Officer*

*Director of Patents and Trademarks*